US008602819B2

(12) United States Patent
Uchida

(10) Patent No.: US 8,602,819 B2
(45) Date of Patent: Dec. 10, 2013

(54) CONNECTOR

(75) Inventor: Tomohisa Uchida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/234,189

(22) Filed: Sep. 16, 2011

(65) Prior Publication Data

US 2012/0083149 A1 Apr. 5, 2012

(30) Foreign Application Priority Data

Oct. 1, 2010 (JP) ..... 2010-223971

(51) Int. Cl.
*H01R 13/40* (2006.01)

(52) U.S. Cl.
USPC ..... 439/596

(58) Field of Classification Search
USPC ..... 439/752, 871, 595
See application file for complete search history.

(56) References Cited

U.S. PATENT DOCUMENTS

| | | | | |
|---|---|---|---|---|
| 6,193,551 | B1 | 2/2001 | Yamamoto et al. | |
| 6,716,069 | B2 * | 4/2004 | Nakamura et al. | 439/752 |
| 6,764,334 | B2 * | 7/2004 | Tsuji et al. | 439/595 |
| 6,817,901 | B2 * | 11/2004 | Nishide | 439/595 |
| 7,063,567 | B2 | 6/2006 | Ishikawa | |
| 2002/0193014 | A1 | 12/2002 | Nakamura et al. | |
| 2003/0157820 | A1 | 8/2003 | Tsuji | |
| 2003/0157835 | A1 | 8/2003 | Ishikawa et al. | |
| 2003/0207616 | A1 | 11/2003 | Nishide | |

* cited by examiner

*Primary Examiner* — Neil Abrams
*Assistant Examiner* — Travis Chambers
(74) *Attorney, Agent, or Firm* — Gerald E. Hespos; Michael J. Porco; Matthew T. Hespos

(57) ABSTRACT

A connector housing (20) includes cavities (30) into which terminal fittings (90) are to be inserted, a front wall (40) capable of stopping the terminal fittings (90) inserted into the cavities (30) at front end positions, and resiliently deformable locking lances (33) cantilever from inner surfaces of the cavities (30). Projections (50) project from a side where the front wall (40) is located toward a side where the locking lances (33) are located. The projections (50) are arranged to contact the locking lances (33) from an opposite side in a resilient deforming direction of the locking lances (33) when the locking lances (33) are about to be deformed excessively.

18 Claims, 10 Drawing Sheets

CONNECTOR

BACKGROUND OF THE INVENTION

1. Field of the Invention

The invention relates to a connector.

2. Description of the Related Art

U.S. Pat. No. 7,063,567 discloses a conventional connector that has a housing formed with a cavity and a terminal fitting accommodated in the cavity. A resiliently deformable locking lance is cantilevered forward along an inner surface of the cavity and retains the terminal fitting that has been inserted properly inserted into the cavity. The housing also is formed with an excessive deformation preventing portion that contacts the locking lance to stop excessive deformation. The excessive deformation preventing portion is formed by an inner surface facing the locking lance with a deformation space for the locking lance defined therebetween.

The locking lance, the deformation space for the locking lance and the excessive deformation preventing portion are juxtaposed in a resilient deforming direction of the locking lance. Thus, significant miniaturization of the connector in the resilient deforming direction of the locking lance is difficult.

The invention was developed in view of the above situation and an object thereof is to realize the miniaturization of a connector.

SUMMARY OF THE INVENTION

The invention relates to a connector with a housing that has at least one cavity for receiving a terminal fitting. The housing has a front wall for stopping the terminal fitting at a front end position in the cavity. A resiliently deformable locking lance is cantilevered along an inner surface of the cavity and retains a terminal fitting that has been inserted properly into the cavity. At least one projection is arranged to contact the locking lance from a side substantially opposite a resilient deforming direction of the locking lance when the locking lance is about to be excessively resiliently deformed to stop further deformation of the locking lance. The projection projects from a side where the front wall is located toward a side where the locking lance is located. Thus, a space in which the projection and the locking lance are juxtaposed in the resilient deforming direction of the locking lance can be made small and the connector can be miniaturized.

A leading end portion of the projection is located on a planned passage path of a leading end portion of the locking lance when the locking lance is about to be deformed excessively. Thus, the leading ends of the locking lance and the projection contact each other, and, the space in which the projection and the locking lance are juxtaposed in the resilient deforming direction of the locking lance can be made smaller.

The locking lance and the projection include parts that overlap each other in their projecting directions when the locking lance is not resiliently deformed. Thus, the connector also can be miniaturized in the projecting directions of the locking lance and the projection.

Leading tip ends of the projection and the locking lance do not overlap each other in the resilient deforming direction of the locking lance when the locking lance is not deformed. Thus, a deformation space for the locking lance is ensured to have a specified large dimension.

The connector preferably has plural cavities and a partition wall between two adjacent cavities. The projection doubles as the partition wall. Thus, further miniaturization of the connector can be realized as compared with the case where the projection and the partition wall are juxtaposed in the resilient deforming direction of the locking lance.

The projection preferably is integral or unitary with the front wall to avoid a complicated construction.

The housing preferably has a main body with at least one cavity and a front holder mounted to the main body and covering at least part of the front surface of the main body.

The front wall and the projection preferably are formed on the front holder. Thus, the locking lance and the projection can be molded without any problem even if they include parts that overlap in the resilient deforming direction of the locking lance.

The locking lance is hidden behind the front wall and cannot be seen from the front when the front wall covers the front surface of the housing.

At least one cutout preferably is formed in the partition wall at the outer lateral side of the locking lance. The locking lances that are adjacent in the width direction are proximately arranged via the cutouts.

Spaces preferably are formed by cutting out the partition walls between the locking lances in one row and those in another row. The spaces preferably are right before the base ends of the locking lances so that the locking lance pushed up by the terminal fitting enters the space in the process of inserting the terminal fitting into the cavity.

The housing preferably has plural cavities. The projection preferably has a first surface that supports the terminal fitting properly inserted into the adjacent cavity and a second surface substantially parallel to the first surface at a side substantially opposite the first surface.

The first surface preferably is arranged substantially over the entire length of the projection and the second surface preferably is at a base part of the projection.

A leading end surface of the locking lance preferably defines a locking surface that is engageable with the terminal fitting. The locking surface preferably is inclined somewhat up with respect to a vertical axis in the height direction and is near the front end of the housing main body when the locking lance is not deformed.

One or more retracted surfaces inclined obliquely down preferably are formed at portions of the leading end surface of each projection. The leading end of the locking lance passes right below the retracted surfaces in the process of resiliently deforming the locking lance, thereby avoiding interference with the projection.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
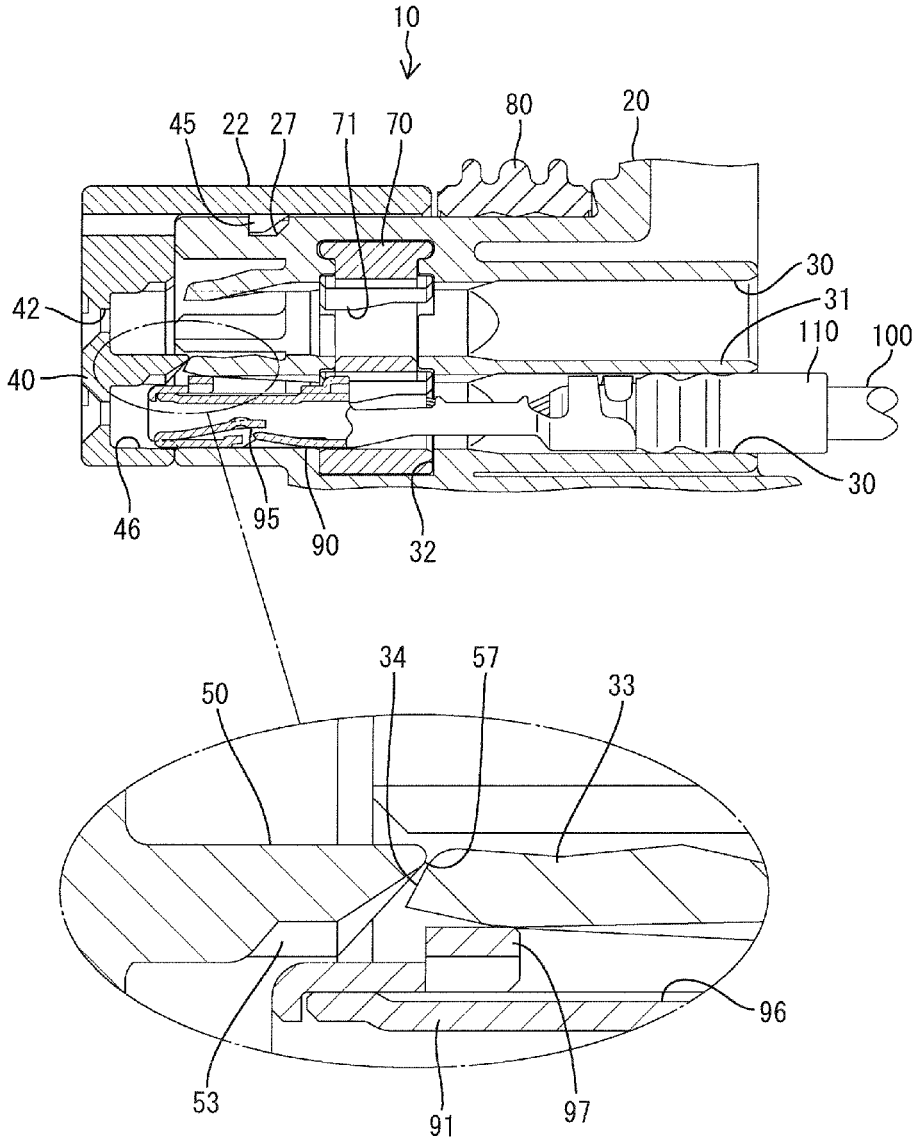
FIG. 1 is a section with a locking lance maximally resiliently deformed within a proper resilient deformation range and near a projection in a connector of the invention.
Figure 2:
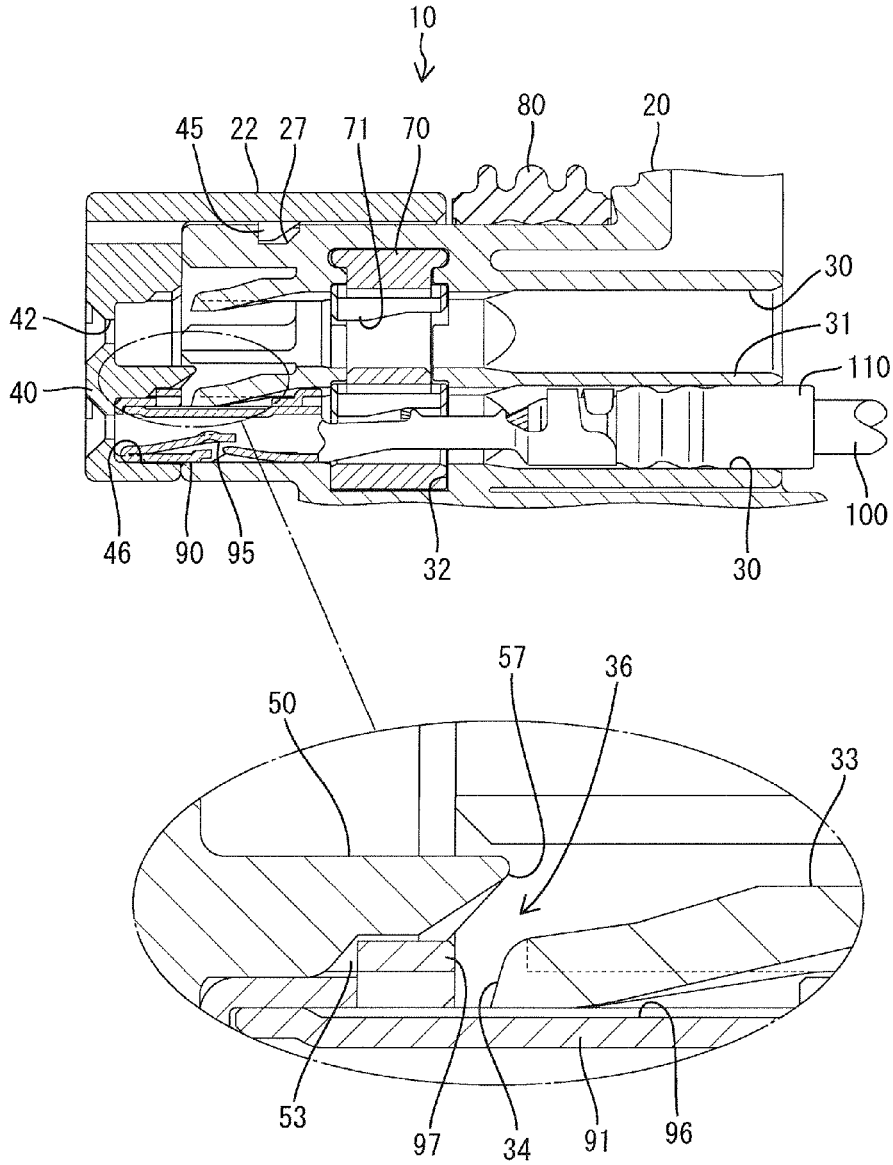
FIG. 2 is a section showing a terminal fitting properly inserted in a cavity of a housing.
Figure 3:
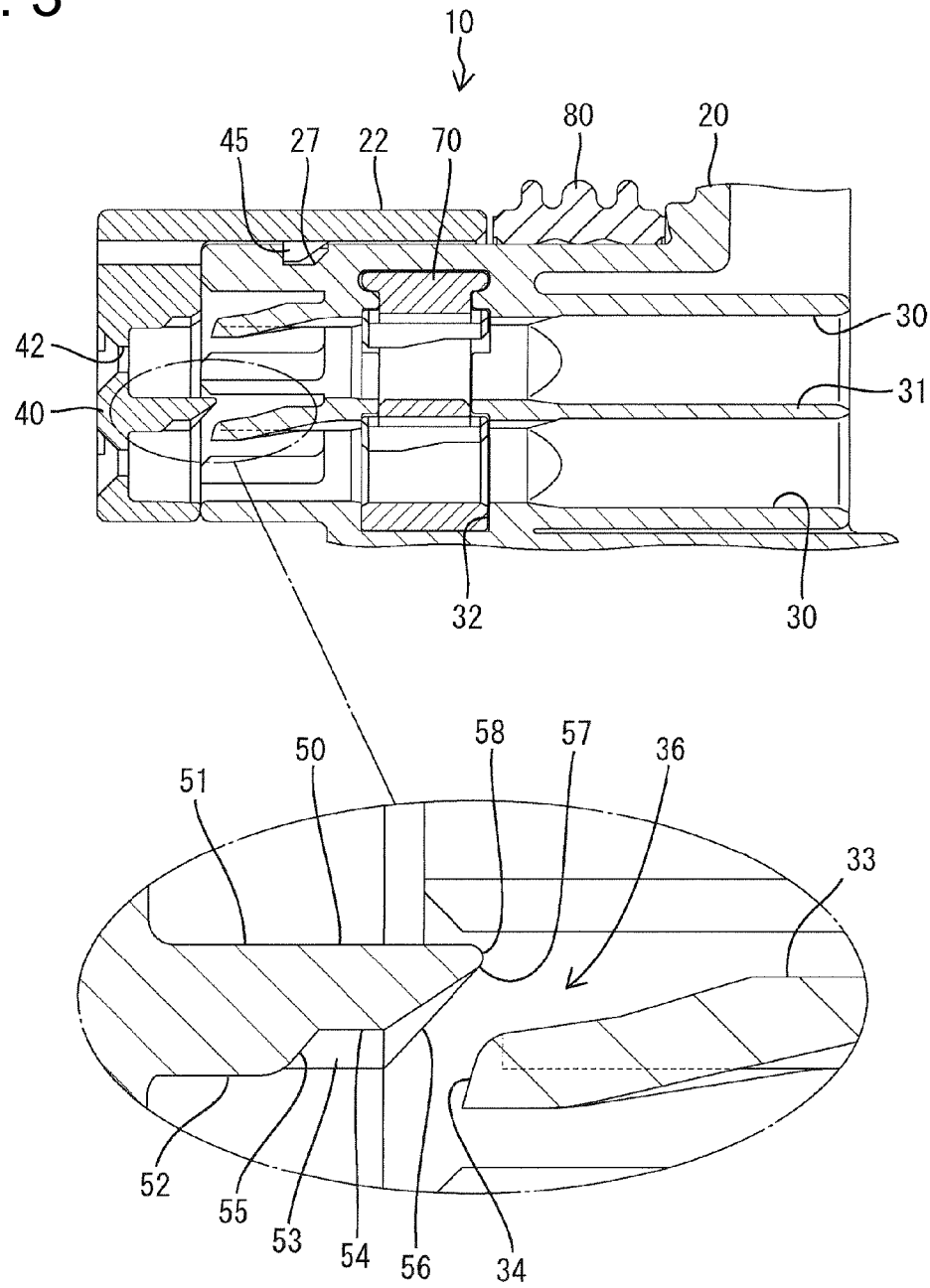
FIG. 3 is a section of the housing.

A connector in accordance with the invention is identified by the numeral 10 in FIGS. 1 to 3. The connector 10 includes a housing 20 and terminal fittings 90 accommodated in the housing 20. The housing 20 is connectable to an unillustrated mating housing. In the following description, the end to be connected to the mating housing is referred to as the front concerning forward and backward directions.

Figure 6:
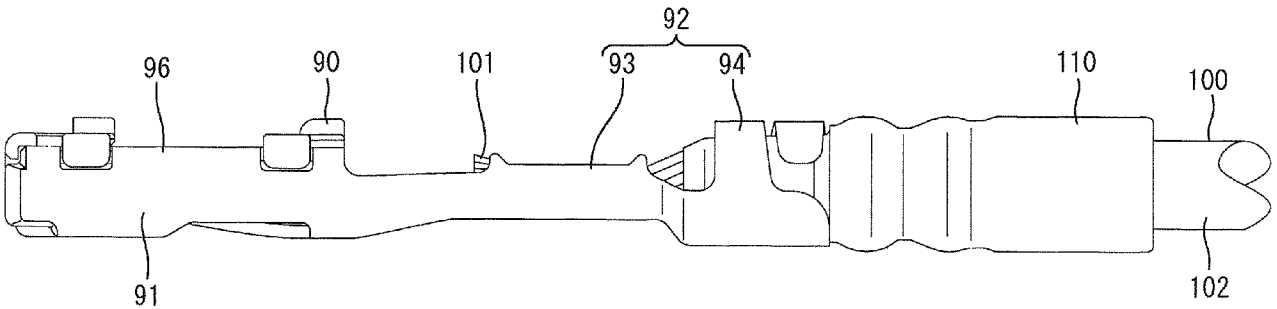
FIG. 6 is a side view of the terminal fitting.

Each terminal fitting 90 is long and narrow in forward and backward directions, as shown in FIG. 6, and is formed unitarily by bending, folding and/or embossing an electrically conductive metal plate. The terminal fitting 90 includes a tubular terminal main body 91 and a wire connection portion to be connected with a wire. The wire connection portion has a barrel portion 92 behind the terminal main body 91. The barrel portion 92 includes a wire barrel 93 to be crimped, bent or folded into connection with a core 101 exposed at an end of a wire 100 and an insulation barrel 94 located behind the wire barrel 93. The insulation barrel 94 is to be crimped, bent or folded into connection with a resilient rubber plug 110 mounted on an insulation coating 102 near the end of the wire 100.

A resiliently deformable resilient contact piece 95 is folded back from the front end of the lower wall of the terminal main body 91 as shown in FIG. 1. A male tab of a mating terminal fitting can be inserted into the terminal main body 91 as the two housings are connected, and the inserted male tab resiliently contacts the resilient contact piece 95.

The upper wall of the terminal main body 91 is made up of two walls placed one over the other in a height direction, and a stepped or recessed lance receiving portion 96 is formed in an intermediate part of the outer wall. Further, a locking projection 97 projects from the upper wall of the terminal main body 91. The locking projection 97 is arranged substantially at a position defining the front edge of the lance receiving portion 96.

Figure 10:
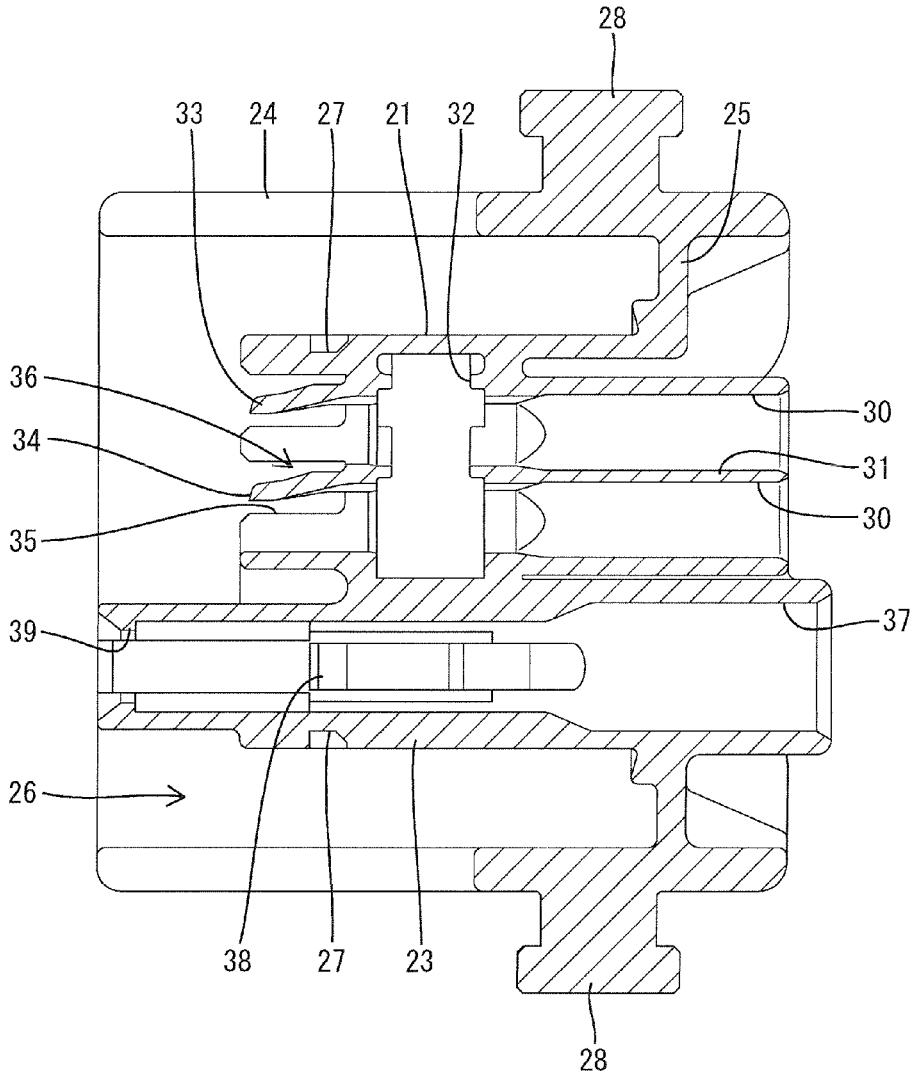
FIG. 10 is a section of the housing main body.

The connector housing 20 is made e.g. of synthetic resin and includes a housing main body 21. A front holder 22 is mounted on the housing main body 21 to cover the front surface of the housing main body 21. A tower 23 is unitary with a lower end of the housing main body 21 and extends in forward and backward directions. A fitting tube 24 at least partly covers the housing main body 21 and the tower 23. As shown in FIG. 10, a radially extending connecting portion 25 unitarily joins the housing main body 21 and the tower 23 to the fitting tube 24. Further, a connection space 26 is defined inward of the fitting tube 24 and outward of the housing main body 21 and the tower 23. A receptacle of the mating connector housing can fit into the connection space 26 from the front. The front ends of the tower 23 and the fitting tube 24 are aligned with one another and are forward of the front end of the housing main body 21. An annular seal 80 is to be mounted on the outer peripheral surfaces of the housing main body 21 and the tower 23. The seal 80 is held resiliently in close contact with the outer peripheral surfaces of the housing main body 21 and the tower 23 and the inner peripheral surface of the receptacle to seal between the two connector housings in a fluid- or liquid-tight manner. Further, each of the upper and lower outer surfaces of the housing main body and the like 21, 23 are recessed to form a pair of holder engaging portions 27.

Figure 4:
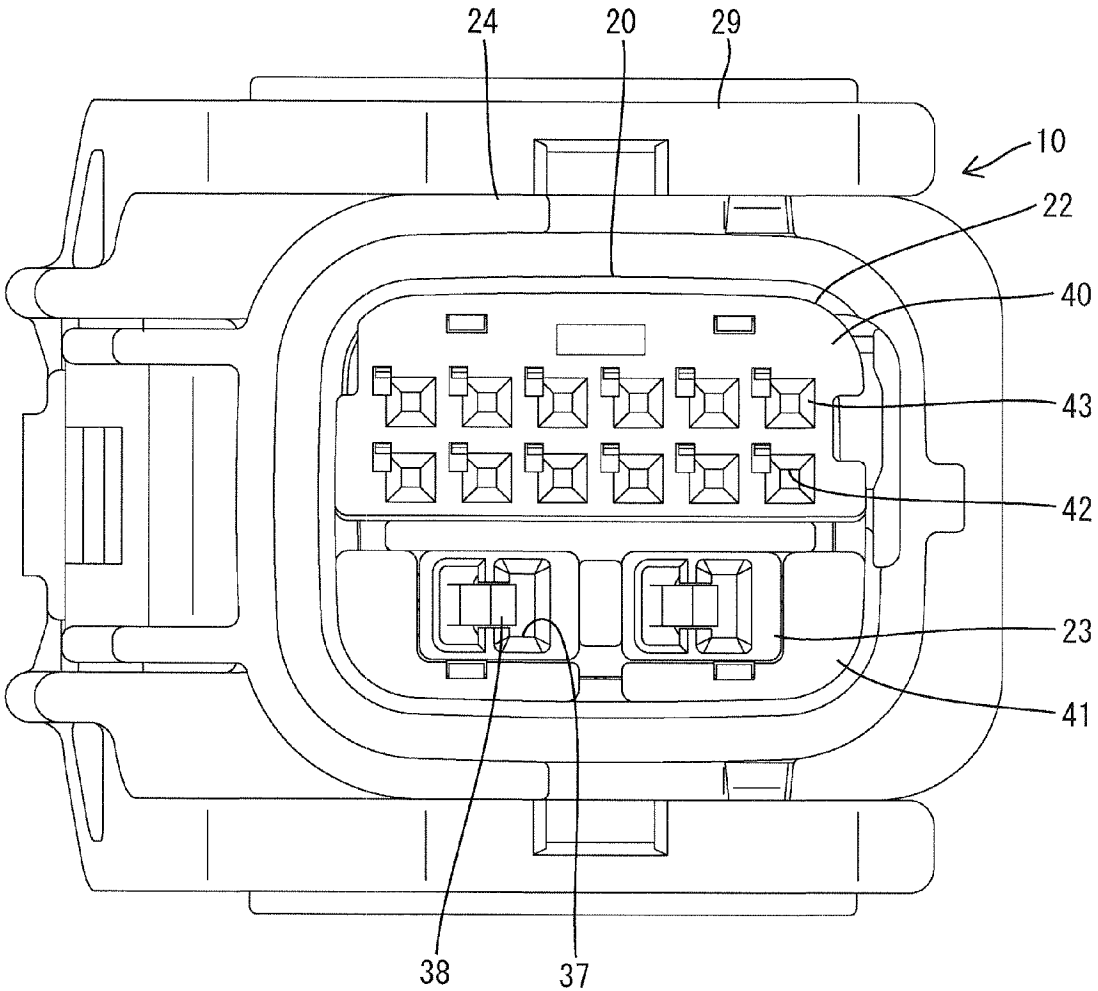
FIG. 4 is a front view of the housing.

Supporting shafts 28 project from the outer upper and lower outer surfaces of the fitting tube portion 24. A lever 29 (see FIG. 4) is mounted on the supporting shafts 28 and a connecting operation of the two connector housings can progress by rotating the lever 29 about the supporting shafts 28. It should be understood, however, that the operable member may be embodied differently, e.g. by a slider substantially linearly displaceable and exhibiting a cam action to perform or assist connection of the housings.

Figure 5:
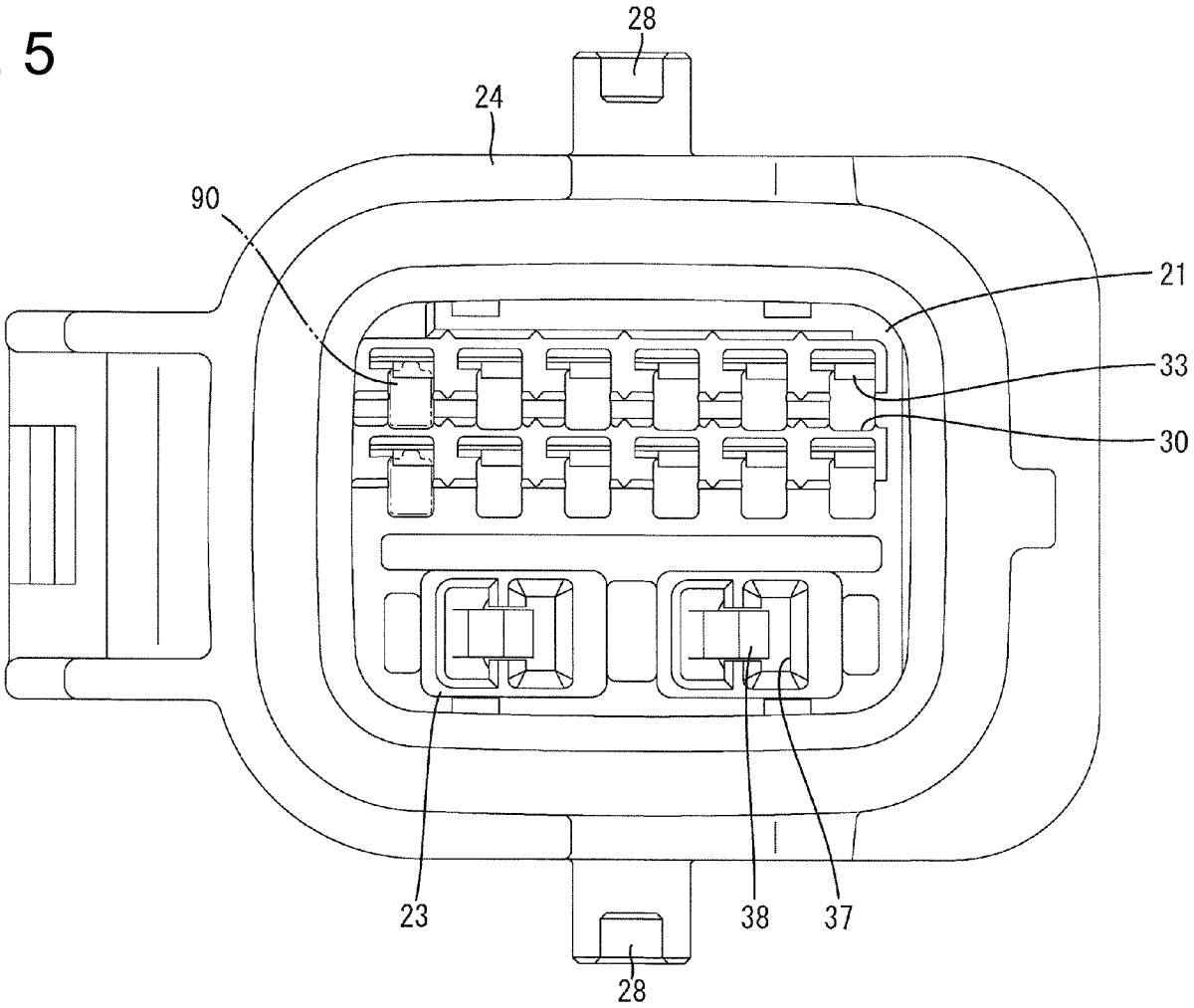
FIG. 5 is a front view of a housing main body.

As shown in FIGS. 5 and 10, the housing main body 21 has cavities 30 arranged in rows or stages in a height direction and columns in a width direction. The cavities 30 penetrate through the housing main body 21 in forward and backward directions. Partition walls 31 partition the cavities 30 that are adjacent to each other in the width and/or height directions. The terminal fitting 90 and the resilient plug 110 are to be inserted into each cavity 30 from behind. With the terminal fitting 90 properly inserted in each cavity 30, the rear end of the rubber plug 110 projects backward from the rear end of the housing main body 21.

A mount hole 32 for a retainer 70 is formed in a side surface of the housing main body 21. The mount hole 32 has a depth to communicate with all of the cavities 30. The retainer 70 is mounted in the housing main body 21 for movement between a partial locking position (first position) and a full locking position (second position). At the partial locking position, retaining portions 71 of the retainer 70 are retracted from the cavities 30 to permit insertion and withdrawal of the terminal fittings 90 into the cavities 30. At the full locking position, the retaining portions 71 of the retainer 70 enter the cavities 30 and face the rear edges of the terminal main bodies 91 to retain the terminal fittings 90.

A locking lance 33 cantilevers forward from a position on upper surface of the inner wall of each cavity right before the mount hole 32 in the housing main body 21. The locking lance 33 is resiliently deformable in the height direction (deformation direction DD intersecting an insertion direction of the terminal fitting 90 into the cavity 30) with a base end thereof as a supporting point. The locking lance 33 in its natural state extends obliquely down and in from the base end to the leading end thereof, and the locking lance 33 that has been resiliently deformed to a maximum extent lies substantially horizontally and along the insertion direction of the terminal fitting 90 into the cavity 30 from the base end to the leading end thereof. A locking surface 34 is defined at the front or leading end surface of the locking lance 33 and is engageable with the locking projection 97 of the terminal fitting 90. The locking surface 34 is inclined upward with respect to a vertical axis in the height direction and is near the front end of the housing main body 21 when the locking lance 33 is in the natural state.

Cutouts 35 are formed in the partition walls 31 at the opposite outer lateral sides of the locking lance 33. The locking lances 33 adjacent in the width direction are arranged proximately via the cutouts 35. Further, spaces 36 are formed by cutting out the partition walls 31 between the locking lances 33 in the lower row and those in the upper row. The spaces 36 are arranged right before the base end parts of the locking lances 33. The locking lance 33 is pushed up by the locking projection 97 in the process of inserting the terminal fitting 90 into the cavity 30 and enters the space 36.

The tower 23 also is formed with two larger cavities 37 particularly substantially arranged in the width direction. The larger cavities 37 are larger in cross section and longer in forward and backward directions than the cavities 30. A resiliently deformable larger locking lance 38 is formed at a side surface of the inner wall of each larger cavity 37. A large terminal fitting 90 is to be inserted into each larger cavity 37 and the properly inserted large terminal fitting 90 is retained by the larger locking lance 38. Note that the housing main body 21 is not formed with a wall for stopping the terminal fittings 90 properly inserted into the cavities 30 at their front end positions. On the other hand, the tower 23 is formed with a wall 39 for stopping the large terminal fittings 90 properly inserted into the larger cavities 37 at their front end positions.

Figure 7:
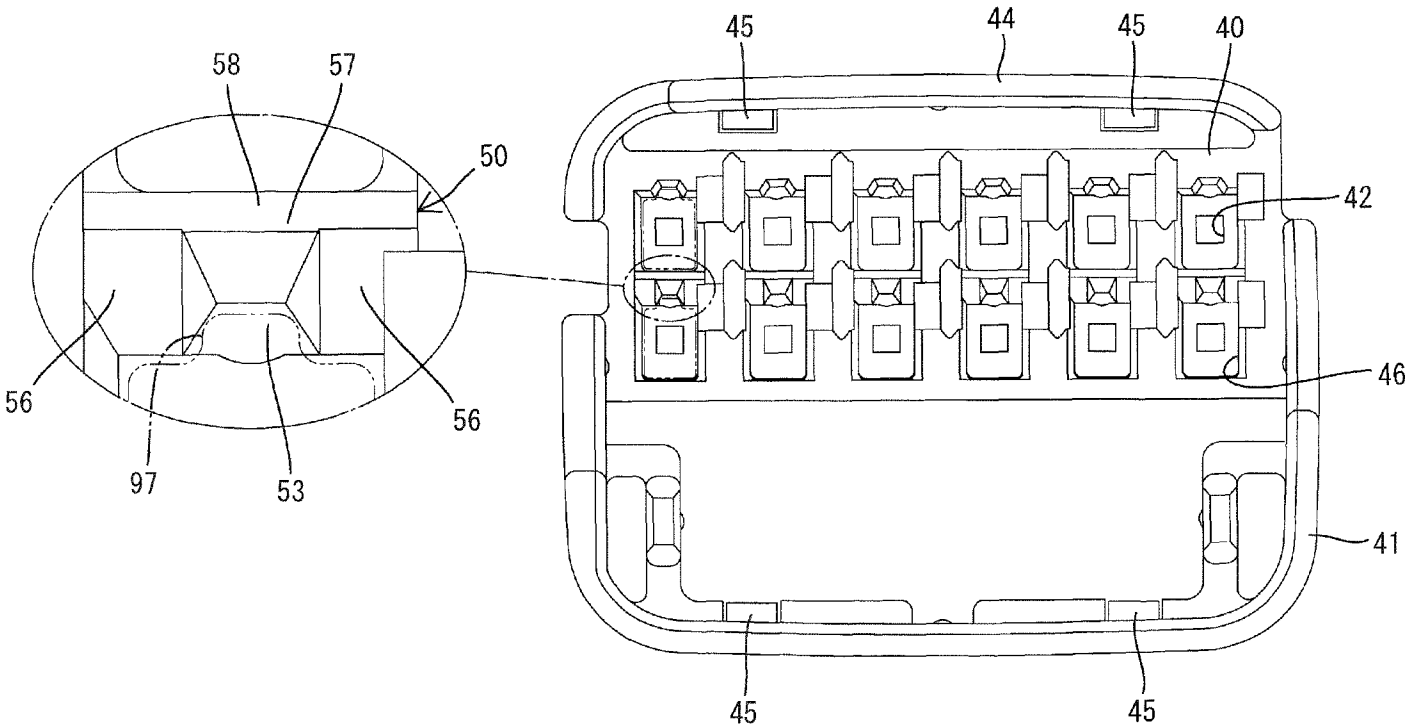
FIG. 7 is a rear view of a front holder.
Figure 8:
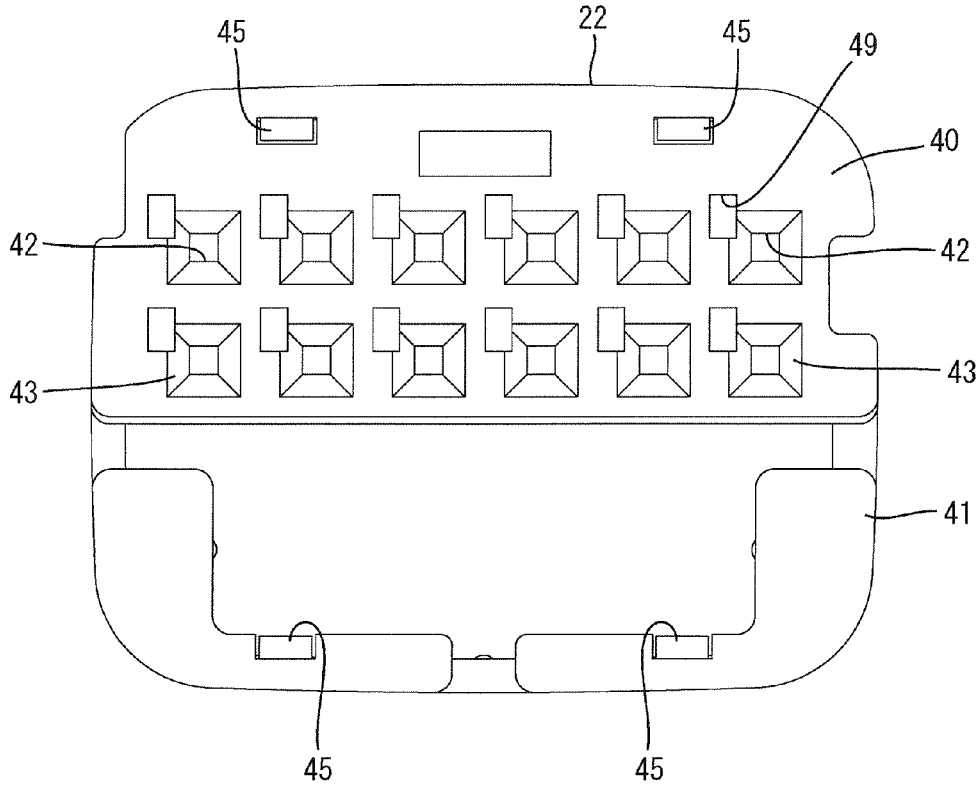
FIG. 8 is a front view of the front holder.
Figure 9:
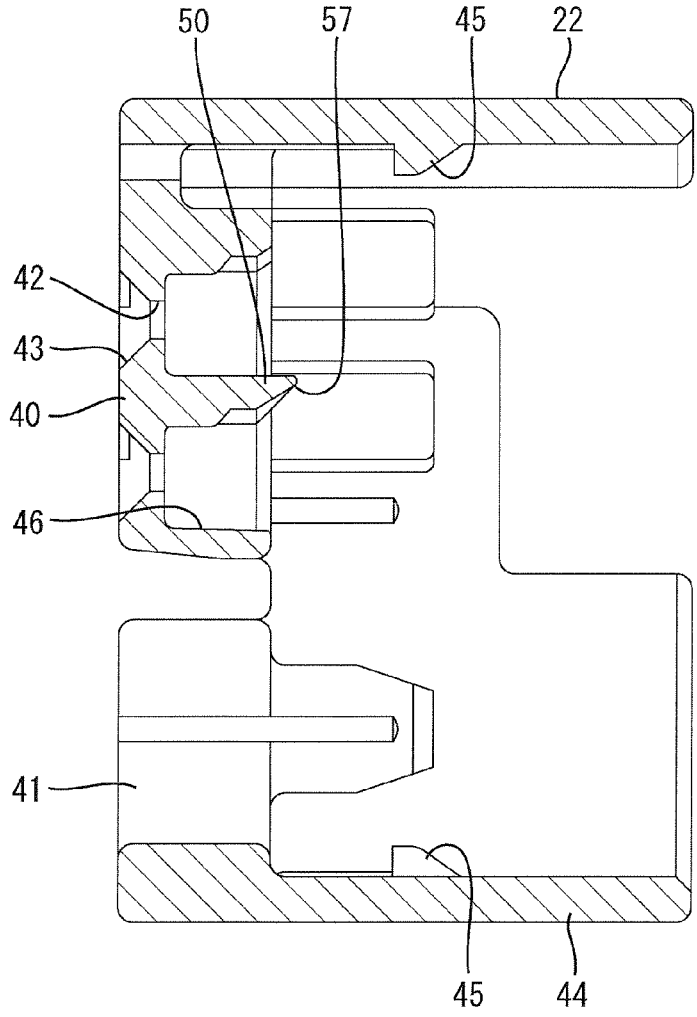
FIG. 9 is a section of the front holder.

The front holder 22 is made e.g. of synthetic resin and includes a front wall 40 in the form of a flat plate for substantially covering the front of the housing main body 21 and a surrounding portion 41 substantially in the form of a frame connected to the opposite widthwise ends of the lower surface of the front wall 40 and at least partly surrounding a front end of the tower 23 as shown in FIGS. 7 to 9. The locking lances 33 are hidden behind the front wall 40 and cannot be substantially seen from front.

The front wall 40 is formed with tab insertion holes 42 at positions substantially corresponding to the respective cavities 30. Substantially conical or converging guiding portions 43 are formed on the opening edges of the respective tab insertion holes 42 in the front surface of the front wall 40. When the two housings are connected, the male tabs of the mating terminal fittings are guided by the guiding portions 43 and inserted into the tab insertion holes 42 and further inserted into the cavities 30 of the housing main body 21.

A tubular portion 44 for covering the housing main body and the like 21, 23 projects back from peripheral edge portions of the front wall 40 and the surrounding portion 41. Two holder locks 45 project from each of the upper and lower inner surfaces of the tubular portion 44. The holder locks 45 resiliently engage with the holder engaging portion(s) 27 when the front holder 22 is mounted to the housing main body 21 to hold the front holder 22 on the housing main body 21. At this time, the front wall 40 is arranged to contact the front end of the housing main body 21 and the rear end of the upper wall of the tubular portion 44 is arranged right before the seal 80.

Fitting recesses 46 are formed in the rear surface of the front wall 40 at positions substantially corresponding to the respective cavities 30. A front end portion of the terminal main body 91 is fit into the fitting recess 46 when the terminal fitting 90 is inserted properly into the cavity 30 of the housing main body 21. At this time, the front end of the terminal fitting 90 contacts the back surface of the fitting recess 46 (rear surface of the front wall 40) to stop the terminal fitting 90 at its front end position.

Projections 50 are so formed on the rear surface of the front wall 40 and project back toward the locking lances 33. The respective projections 50 form part of the upper walls of the fitting recesses 46. When the front holder 22 is mounted to the housing main body 21, the respective projections 50 are arranged substantially at the same heights as the partition walls 31 and leading end portions thereof are arranged at positions displaced from the locking lances 33 in the height direction as shown in FIG. 3.

Each projection 50 includes a substantially horizontal upper or inner surface 51 that supports the terminal main body 91 of the terminal fitting 90 that has been inserted properly into the cavity 30 in the adjacent or upper row from outside or below and a lower surface substantially parallel to the upper surface 51 at a side opposite to the upper surface 51. The upper surface 51 is arranged substantially over the entire length of the projection 50 and the lower surface 52 is arranged at a base part of the projection 50.

The lower surface of a leading end portion of each projection 50 is recessed in a widthwise intermediate part to form a receiving groove 53 that receives the locking projection 97 of the terminal fitting 90 properly inserted into the cavity 30. The groove surface of the receiving groove 53 includes a substantially horizontal flat surface 54 facing the upper surface of the locking projection 97 and an oblique surface 55 inclined obliquely down while facing the front edge of the locking projection 97.

Two retracted surfaces 56 are inclined obliquely down at portions of the leading end surface of each projection 50 at the opposite sides of the receiving groove 53 in the width direction. In the process of resiliently deforming the locking lance 33, the leading end of the locking lance 33 passes right below the retracted surfaces 56, thereby avoiding interference with the projection 50.

The leading end portion of the projection 50 is arranged at a position at least partly overlapping a planned passage path of the leading end portion of the locking lance 33 about to be excessively resiliently deformed, i.e. at such a position as to be able to interfere with the leading end of the locking lance 33 in a state where the front holder 22 is mounted to the housing main body 21. A contact portion 57 with which the locking lance 33 about to be excessively resiliently deformed can contact is formed on the leading end portion of the projection 50. This contact portion 57 particularly is arranged between the upper surface portion 51 and the retracted surfaces 56. The contact portion 57 is substantially U-shaped and the leading end thereof serves as a tip end 58 which is a rearmost part of the projection 50.

In a state where the locking lance 33 is not resiliently deformed, the leading ends of the locking lance 33 and the projection 50 are positioned relative to each other for partially overlapping each other in the forward and backward projecting directions of the locking lances 33 and the projection 50. Further, in the state where the locking lance 33 is not resiliently deformed, an upper part of the locking lance 33 and a lower part of the projection 50 are positioned relative to each other so as to at least partly overlap each other in the height direction as a resilient deforming direction of the locking lance 33. On the other hand, in the state where the locking lance 33 is not resiliently deformed, the locking surface 34 of the locking lance 33 and the contact portion 57 (including the tip end 58) of the projection 50 are positioned relative to each other as to be displaced from each other without overlapping in the height direction as the resilient deforming direction of the locking lance 33. At this time, the tip end 58 of the projection 50 is arranged at a position substantially facing the space 36. The already described space 36 is provided between the leading end portion of the locking lance 33 and the tip end 58 of the projection 50.

The retainer 70 is held at the partial locking position and the front holder 22 is mounted to the housing 20 prior to accommodating the terminal fittings 90 into the connector housing 20.

Subsequently, each terminal fitting 90 is inserted into the cavity 30 from behind. In the insertion process, the locking projection 97 interferes with the locking lance 33 and resiliently deforms the locking lance 33 in the deforming direction DD toward the space 35. The locking lance 33 is deformed maximally within the normal resilient deformation range when the front end of the terminal main body 91 is inserted into the fitting recess 46 at a final stage of the insertion, and the locking surface 34 of the locking lance 33 approaches the contact portion 57 of the projection 50 as shown in FIG. 1. The locking surface 34 of the locking lance 33 contacts the contact portion 57 of the projection 50 if the locking lance 33 is deformed beyond the normal resilient deformation range, for example, due to inclination of the terminal fitting 90 from its proper insertion posture. The contact state of the locking lance 33 and the projection 50 in this way prevents an excessive deformation of the locking lance 33 beyond the normal range. Accordingly, the locking lance 33 is prevented from entering the cavity 30 in the upper row and an inserting operation of the terminal fitting 90 into the cavity 30 in the upper row can be performed without problem.

When the terminal fitting 90 is inserted properly into the cavity 30, the front end portion of the terminal main body 91 is fit properly into the fitting recess 46, the locking projection 97 is fit properly into the receiving groove 53 and the terminal main body 91 contacts the front wall 40 to be stopped at its front end position, as shown in FIG. 2. The locking lance 33 resiliently returns as the locking projection 97 passes the locking lance 33 and the leading end portion of the locking lance 33 enters the lance receiving portion 96 and the locking surface 34 thereof is arranged to contact the locking projection 97 from behind. In this way, the terminal fitting 90 is retained and held in the cavity 30. Thereafter, the retainer 70 is pushed to the full locking position (second position) for doubly retaining the terminal fittings 90.

One or more terminal fittings 90 may have to be withdrawn from the cavities 30 for maintenance or the like. Accordingly, the retainer 70 is returned to the partial locking position (first position) and an unillustrated jig is inserted into the cavity 30 through a jig insertion hole 49 (see FIG. 8) in the front wall 40 of the front holder 22. The locking lance 33 is hooked by the leading end of the jig and, in this state, lifted up to be deformed resiliently. Thus, the locking surface 34 of the locking lance 33 is retracted from the locking projection 97 of the terminal fitting 90 and the terminal fitting 90 can be withdrawn from the cavity 30. At this time, the locking surface 34 of the locking lance 33 contacts the contact portion 57 of the projection 50 to limit deformation of the locking lance 33 and to prevent an excessive deformation of the locking lance 33.

As described above, excessive deformation of each locking lance 33 is prevented by the projection 50. The projection 50 projects from a side where the front wall 40 is located to a side where the locking lance 33 is located. Thus, a space in which the projection 50 is juxtaposed with the locking lance 33 in the resilient deforming direction of the locking lance 33 (height direction) can be small. As a result, the connector 10 can be miniaturized.

The leading end of the projection 50 is on the planned passage path of the leading end of the locking lance 33 about to be excessively resiliently deformed. Thus, the leading ends of the locking lance 33 and the projection 50 contact each other. Therefore, the space in which the projection 50 is juxtaposed with the locking lance 33 in the resilient deforming direction DD of the locking lance 33 can be made smaller.

The locking lance 33 and the projection 50 include parts that overlap each other in forward and backward directions as the projecting directions of the locking lance 33 and the projection 50 in the state where the locking lance 33 is not resiliently deformed. Thus, the connector 10 can be miniaturized in forward and backward directions. Further, the tip end 58 of the leading end portion of the projection 50 and the locking surface 34 of the locking lance 33 do not overlap each other in the height direction in the state where the locking lance 33 is not resiliently deformed. Thus, the space 36 can be large.

The projections 50 double as the partition walls 31 of the cavities 30. Thus, further miniaturization of the connector 10 can be realized as compared with the case where the projections 50 and the partition walls 31 are juxtaposed in the height direction.

The projections 50 and the front wall 40 are integral or unitary formed. Thus, a complicated construction can be avoided. Furthermore, since the front wall 40 and the projections 50 are formed on the front holder 22, the locking lances 33 and the projections 50 can be mold-formed without any problem even if they include parts that overlap in the resilient deforming direction of the locking lances 33.

The invention is not limited to the above described and illustrated embodiment. For example, the following embodiments are also included in the scope of the invention.

The projections and the front wall may be formed separately from each other.

The projections may be formed on a front wall other than that of the front holder.

The locking lance may be arranged to engageable the rear edge of the terminal main body.

The invention is also applicable to non-watertight connectors with no seals or rubber plugs.

The invention is also applicable to male connectors in which male terminal fittings are inserted into a housing.

What is claimed is:

1. A connector, comprising:

a housing with at least one cavity, a front wall, and a resiliently deformable locking lance cantilevered from an inner surface of the cavity;

a terminal fitting inserted in the cavity, the terminal fitting being configured to deform the locking lance during insertion of the terminal fitting into the cavity and further being configured to permit the locking lance to return resiliently and retain the terminal fitting when a front end of the terminal fitting is abutting the front wall;

at least one projection projecting from a side where the front wall is located toward a side where the locking lance is located, the projection being arranged to permit the locking lance to deform resiliently sufficiently for insertion of the terminal fitting into the cavity, but further being configured to contact the locking lance from a side substantially opposite a resilient deforming direction of the locking lance when the locking lance is about to be deformed excessively.

2. The connector of claim 1, wherein a leading end of the projection is located on a planned passage path of a leading end of the locking lance when the locking lance is about to be deformed excessively.

3. The connector of claim 1, wherein the locking lance and the projection include parts that overlap each other in projecting directions of the locking lance and the projection in a state where the locking lance is not deformed.

4. The connector of claim 1, wherein a tip end of a leading end portion of the projection and a leading end portion of the locking lance do not overlap each other in the resilient deforming direction of the locking lance in a state where the locking lance is not resiliently deformed.

5. The connector of claim 1, wherein:

the at least one cavity comprises at least two adjacent cavities;

a partition wall being formed between the two adjacent cavities; and the projection doubles as the partition wall.

6. The connector of claim 1, wherein a locking surface is formed at a leading end surface of the locking lance and is engageable with the terminal fitting, the locking surface being inclined up with respect to a vertical axis in the height direction and being arranged near the front end of the housing main body when the locking lance is not deformed.

7. The connector of claim 1, wherein at least one retracted surface is inclined obliquely down at a leading end surface of each projection, the leading end of the locking lance passing right below the retracted surfaces during resilient deformation of the locking lance and avoiding interference with the projection.

8. The connector of claim 1, wherein the projection is unitary with the front wall.

9. The connector of claim 8, wherein the housing includes a housing main body with a front surface, the at least one cavity being formed in the housing main body and a front holder mounted to the housing main body and covering the front surface of the housing main body.

10. The connector of claim 9, wherein the front wall and the projection are formed on the front holder.

11. The connector of claim 10, wherein the front wall mounted on the front surface of the housing hides the locking lance.

12. The connector of claim 10, wherein at least one cutout is formed in the partition wall at an outer lateral side of the locking lance wherein the locking lances adjacent in the width direction are arranged proximately via the cutouts.

13. The connector of claim 10, wherein spaces are formed by cutting out the partition walls between the locking lances in one row and those in another row, the spaces being arranged right before the base end parts of the locking lances, so that in the process of inserting the terminal fitting into the cavity, the locking lance pushed up by the terminal fitting enters the space.

14. The connector of claim 1, wherein:

the at least one cavity comprises plural cavities;

the projection includes a first surface that supports the terminal fitting properly inserted into the adjacent cavity and a second surface substantially parallel to the first surface at a side substantially opposite to the first surface.

15. The connector of claim 14, wherein the first surface is arranged over substantially an entire length of the projection and the second surface is arranged at a base part of the projection.

16. A connector, comprising:

a housing with opposite front and rear ends and at least one cavity extending between the front and rear ends, a resiliently deformable locking lance cantilevered forward from an inner surface of the cavity;

a terminal fitting inserted in the cavity from the rear end of the housing, the terminal fitting being configured to deform the locking lance during insertion of the terminal fitting into the cavity and further being configured to permit the locking lance to return resiliently and retain the terminal fitting when the terminal fitting has been inserted to a proper insertion position in the cavity; and a front holder mounted to the front end of the housing and having at least one projection projecting toward the locking lance, the projection being configured to permit the locking lance to deform resiliently sufficiently for insertion of the terminal fitting into the cavity, but further being configured to contact the locking lance from a side substantially opposite a resilient deforming direction of the locking lance when the locking lance is about to be deformed excessively.

17. The connector of claim 16, wherein the housing further has a mount hole extending transversely into the housing rearward of the locking lance and intersecting the cavity and the connector further comprising a retainer inserted into the mount hole and being configured to engage and lock a portion of the terminal fitting rearward of the locking lance.

18. The connector of claim 16, wherein the front holder has a front wall that contacts a front end of the terminal fitting when the terminal fitting is at the proper insertion position in the cavity.

* * * * *